United States Patent [19]

Shimizu

[11] 4,009,601

[45] Mar. 1, 1977

[54] METHOD OF AND APPARATUS FOR BENDING A DOUBLE PIPE

[75] Inventor: Sadaichi Shimizu, Hino, Japan

[73] Assignee: K.K. Shimizu Seisakusho, Tokyo, Japan

[22] Filed: Jan. 21, 1976

[21] Appl. No.: 650,899

[30] Foreign Application Priority Data

| | | |
|---|---|---|
| Jan. 24, 1975 | Japan | 50-10807 |
| Jan. 24, 1975 | Japan | 50-10808 |
| Jan. 24, 1975 | Japan | 50-10809 |

[52] U.S. Cl. ..... 72/369; 72/150

[51] Int. Cl.[2] ..... B21D 9/04

[58] Field of Search ..... 72/150, 214, 369, 215, 72/149, 154, 156, 157, 159, 388, 310, 319, 367, 459, 283, 284, 289, 370; 29/423

[56] References Cited

UNITED STATES PATENTS 3,546,917 12/1970 Paine ..... 29/423 X

*Primary Examiner*—Robert L. Spicer, Jr.
*Assistant Examiner*—John S. Brown
*Attorney, Agent, or Firm*—Spensley, Horn & Lubitz

[57] ABSTRACT

A method of and apparatus for bending a double pipe comprising inserting a smaller diameter pipe into a pipe of larger diameter and coupling the two pipes together at one end, inserting a inner metal core and an outer metal core respectively into the inside of the inner pipe and between the inner and outer pipes, inserting the double pipe into a bending mold, fixing the pipe on a turntable on which the bending mold is rigidly affixed, fixing a section of the double pipe near the end into which the metal cores were inserted thus blocking movement of the fixed section in the radial direction, and driving the turntable in a radial direction while keeping the metal cores in a fixed position and applying a bending force on the double pipe toward the bending mold while pushing the inner pipe in an axial direction from the end into which the metal core was inserted.

5 Claims, 8 Drawing Figures

METHOD OF AND APPARATUS FOR BENDING A DOUBLE PIPE

FIELD OF THE INVENTION

The present invention relates to methods and apparatuses for bending pipe and in particular to methods of and apparatuses for bending a double pipe.

DESCRIPTION OF THE PRIOR ART

It is frequently necessary when utilizing double pipe to have to bend the double pipe. There exists in the prior art methods for bending double wall pipe. One such method is to bend the double pipe on a bending form. This method is undesirable because both the inner and outer pipe tend to flatten out at the point of bending thereby causing a decrease in the cross-sectional area.

In order to overcome this disadvantage, a method for bending pipe such as described in Japanese Patent Application No. 129,932 filed in 1973 was developed by applicant. In this method the inner and outer pipes are fixed such that there is no relative motion of the two pipes during the bending process and metal cores are inserted into the inner pipe and between the inner and outer pipe before the double pipe structure is bent. Since discovering the above-described method for bending double pipe, applicant has observed that when the double pipe is bent in accordance with this method, occasionally the inner pipe makes contact with the inner surface of the outer pipe at the point where the bending is applied. This effect is a result of the fact that the inner pipe is bent less than the outer pipe during the bending process. Furthermore, it was observed that such contact between the inner and outer pipes seldom occurred when the double pipe structure was bent only once. It was observed that during the second bending operation even if the first bending operation was perfect, the inner contact took place between the inner and outer pipes due to the tensil force of the inner pipe acting in the direction of the second bending process.

SUMMARY OF THE INVENTION

In keeping with the principles of the present invention, the objects are accomplished by a unique method of and apparatus for bending a double pipe comprising fixing one end of two coaxial pipes which form a double pipe structure together, inserting an inner metal core and an outer metal core into respectively the inner pipe and between the inner and outer pipes, inserting the double pipe structure into a bending mold, fixing the double pipe on a turntable on which the bending mold is rigidly affixed, affixing a section of the double pipe near the end into which the metal cores were inserted to a fixed table thereby blocking movement of the fixed section in a radial direction, and driving the turntable in a radial direction while keeping the metal cores in a fixed position thereby applying a bending force on the double pipe toward the bending mold; while the bending force is applied to the double pipe, pushing the inner pipe in an axial direction from the end into which the metal core was inserted.

Accordingly, it is a general object of the present invention to provide a method for bending double pipe in which contact between the inner pipe and the outer pipe due to insufficient bending of the inner pipe or due to straightening action of the inner pipe during a second bend is prevented.

It is another object of the present invention to provide an apparatus for bending of the double pipe that does not result in insufficient bending of the inner pipe or straightening of the inner pipe during a second bending operation on the double pipe.

It is yet another object of the present invention to provide an apparatus for bending of a double pipe that does not produce furrows in the inner side of the radial direction of the portion of the pipe that is being bent or produce any flattening of the pipe at the bend.

BRIEF DESCRIPTION OF THE DRAWINGS

The above-mentioned and other features and objects of the present invention will become more apparent by reference to the following description taken in conjunction with the accompanying drawings, wherein like reference numerals denote like elements, and in which.

DESCRIPTION OF THE PREFERRED EMBODIMENTS

Figure 1:
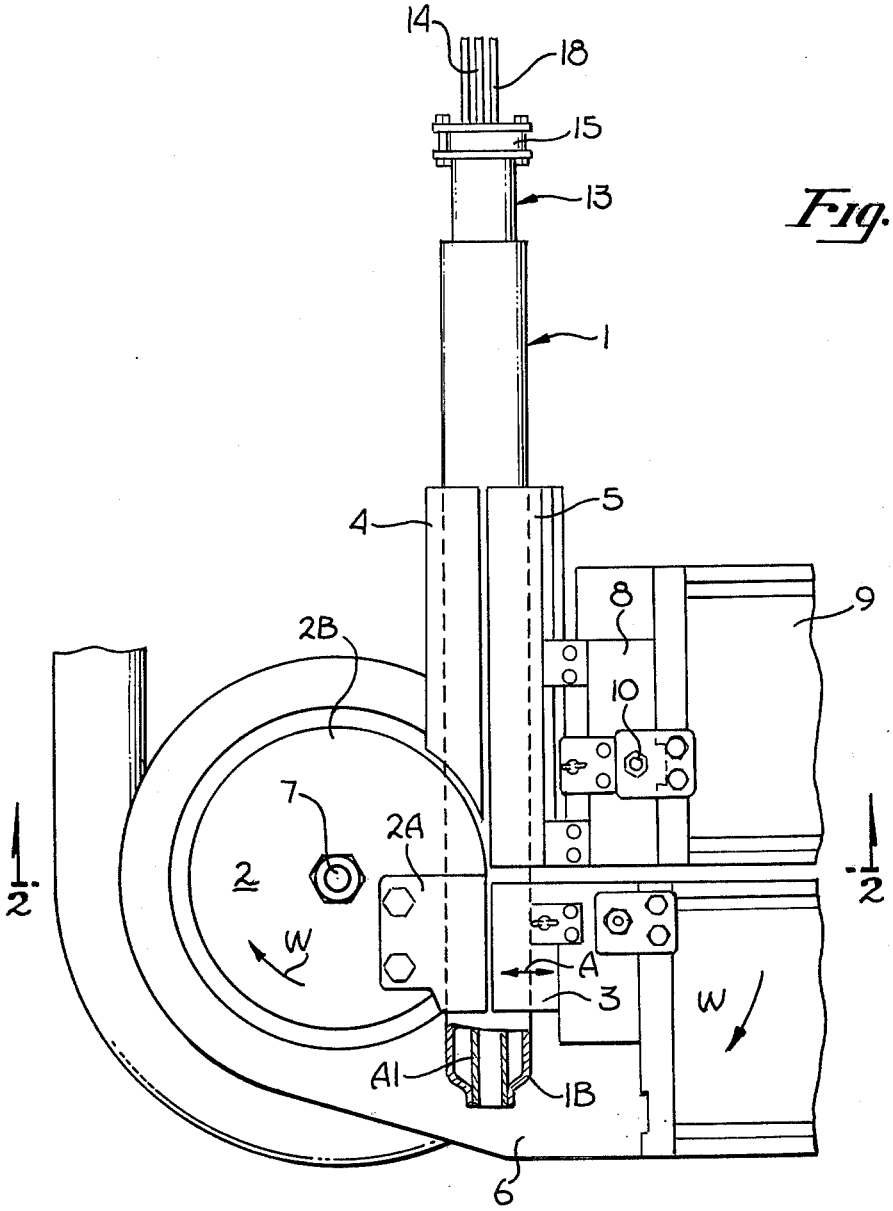
FIG. 1 is a plane view of one embodiment of double pipe bending apparatus in accordance with the teachings of the present invention.
Figure 2:
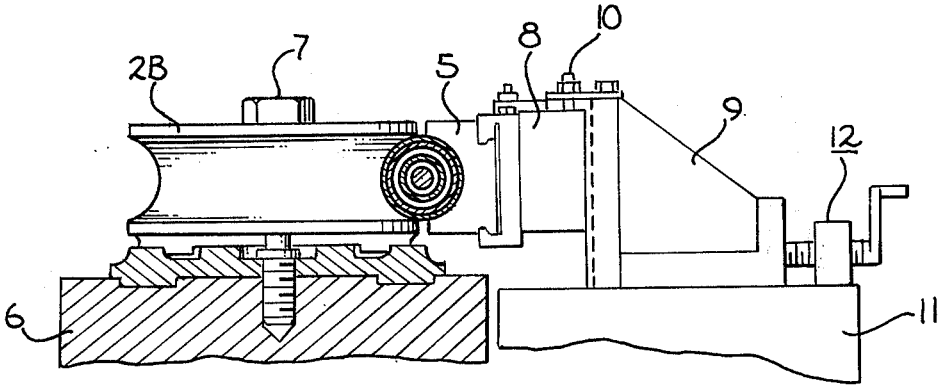
FIG. 2 is a cross-section of the embodiment of FIG. 1 taken on the 2—2 line.
Figure 3:
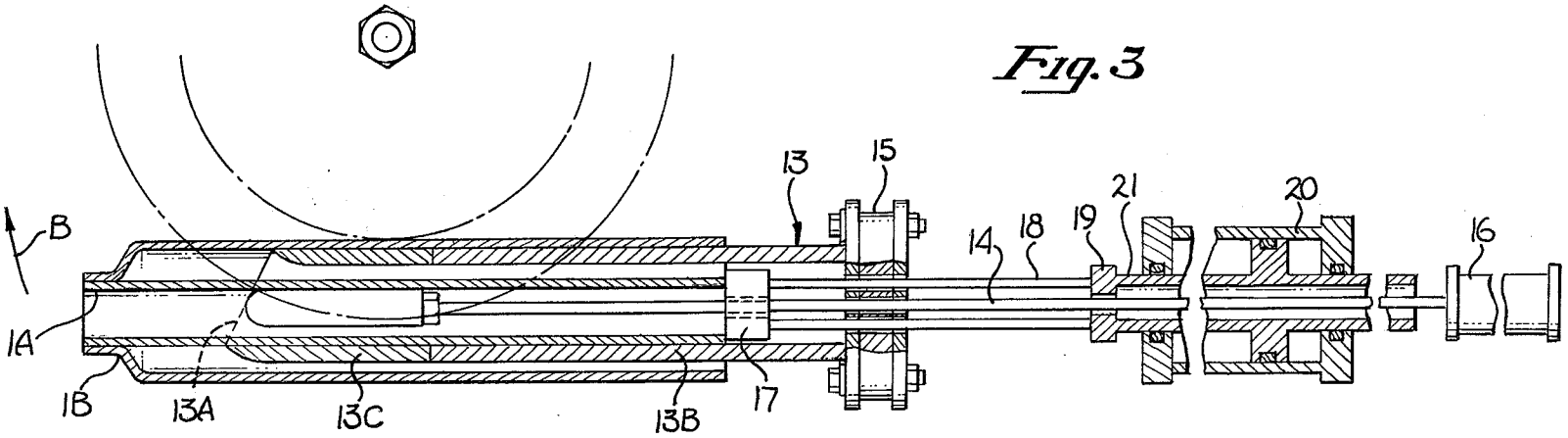
FIG. 3 is an enlarged longitudinal cross-sectional view of the embodiment of FIG. 1 showing the relationship between the double pipes and the metal cores.

As shown in FIGS. 1 and 3, double pipe 1 is formed from an inner pipe 1A and a coaxial outer pipe 1B. Furthermore, one end of inner pipe 1A and outer pipe 1B are welded together so that there will be no relative motion between the coaxial pair. This end forms the front end of double pipe 1. That portion of double pipe 1 which is to be bent is sandwiched between clamp 2A of bending mold 2 and clamp mold 3. Also, the rear end of double pipe 1 is sandwiched between a guide 4 and a press mold 5 for prevention of furrow formation.

Clamp mold 3 is freely movable relative to clamp section 2A in the direction indicated by arrow A. Clamp mold 3 is fixed together with clamp section 2A and bending section 2B, which is made as a single block with clamp section 2A, on turntable 6 in such a way that they can be rotated by the turntable 6 as indicated by the arrow W within a certain range about the central axis 7 of the bending portion 2B that has a circular cross-section. Press mold 5 is coupled to support element 8 which is slidably movable in the longitudinal direction of pipe 1. Support element 8 is coupled via dovetail guides to frame element 9. The height of support element 8 is adjustable by means of rotating adjustment bolt 10. Frame element 9 is coupled to fixed table 11 in such a way that it can slide in the radial direction of pipe 1 by means of a screw mechanism 12. Accordingly, press mold 5 can move along the axial line of pipe 1 in a direction toward its front end while pressing the pipe in the radial direction.

Figure 4:
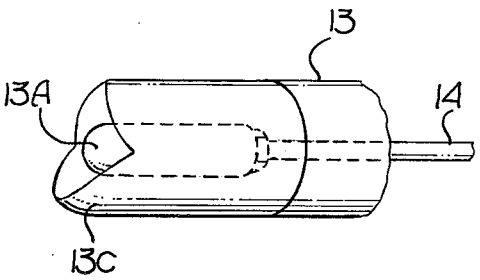
FIG. 4 is a partial view of the front end of the metal core.
Figure 5:
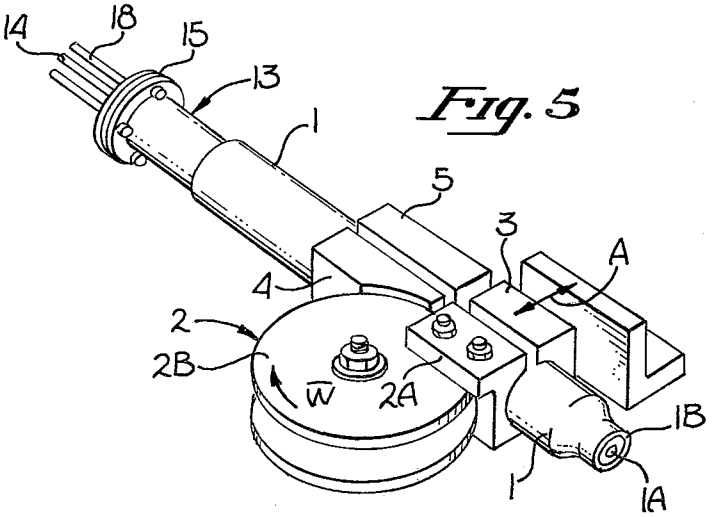
FIg. 5 is a pictorial view of the embodiment of FIG. 1 before the double pipe has been bent.

Metal core 13 is inserted into the double pipe 1 from the rear end. As shown in FIGS. 3 and 4, the metal core 13 consists of an inner metal core 13A which is inserted within inner pipe 1A and an outer metal core 13B which is inserted between the inner pipe 1A and the outer pipe 1B. Inner metal core 13A has a form like those conventionally used for pipe bending and its rear end is rigidly coupled to one end of metal core rod 14. The outer metal core 13B has the form of a hollow pipe and its front end 13C is made of a hardened material. Outer metal core 13B is solidly fixed on said metal core rod 14 at its rear end via flange 15. The front end shape of outer metal core 13B is such that its outer contour in a plane normal to the axis of rotation of bending section 2B is circular, having the axis of rotation as its center. Moreover, the front edge of front end 13C is on the same normal line with inner core 13A that passes through the axis of rotation.

Metal core rod 14 is coupled to a hydraulic drive mechanism 16 and is movable within certain range in the axial direction.

Outer metal core 13B contains a piston 17 for the purpose of pressing inner pipe 1A. Piston 17 is fixed on one end to a number of rods 18 that pass through flange 15. The other end of rods 18 are coupled to transmission link 19. Transmission link 19 is coupled to the front of piston rod 21 of hydraulic drive mechanism 20. Core rod 14 passes through the center of hydraulic drive mechanism 20 and piston rod 21.

In operation, the bending of the double pipe 1 is performed as shown in FIG. 1 by holding the double pipe 1 between clamp section 2A and clamp mold 3 and pushing it by press mold 5 against guide 4, with the metal core 13 inserted in double pipe 1 by the metal core rod 14 up to a prescribed position and fixed there, then driving turntable 6 and rotating the bending mold 2 and clamp mold 3 in the direction indicated by arrow W.

The double pipe 1 which is subjected to the bending force is pulled forward together with press mold 5 due to the rotation of turntable 6 and the double pipe 1 is bent as shown in FIG. 4 without producing flattening nor furrowing because of the metal core 13 inserted into double pipe 1. Furthermore, since the tip of the outer metal core having an outer peripheral surface of which forms a concentric circle with its center at the center of rotation and having a tip on the same normal line as that of the inner core that passes through the center of rotation, flattening and furrowing are substantially eliminated. Although the bending will produce a force that tends to move the inner pipe 1A relative to the outer pipe 1B, the movement will be blocked because the two pipes 1A and 1B are fused together at their one end.

Figure 6:
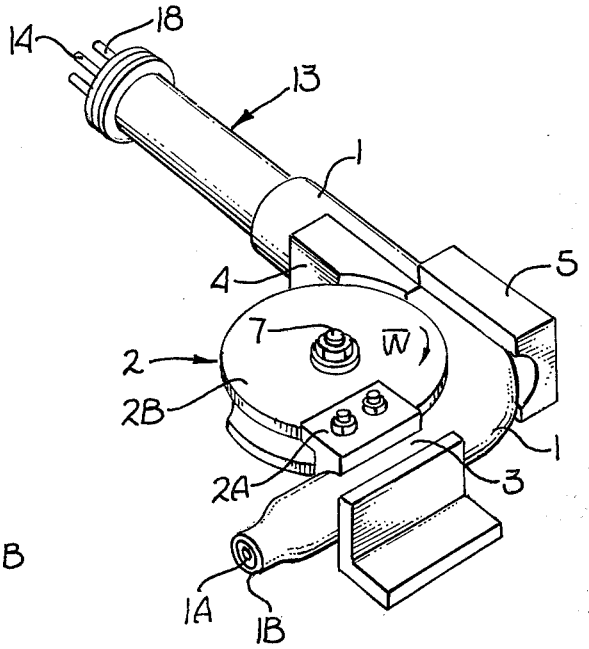
FIG. 6 is a pictorial view of the embodiment of FIG. 1 while the double pipe is being bent.
Figure 7:
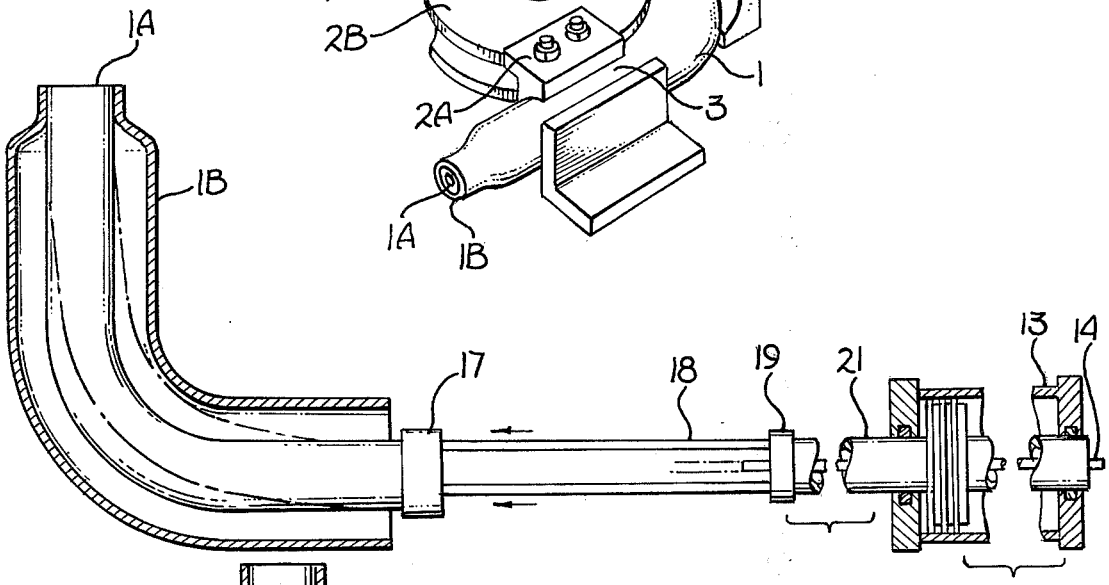
FIG. 7 is an enlarged cross-sectional view of the pertinent parts for the case where the double pipe is bent only once.

Inner pipe 1A is pushed in the direction in which a tension appears in the double pipe 1 due to the bending force by a force which is approximately equal to 1/5 to 1 times the tension force by a piston 17 which is operated by a hydraulic drive mechanism 20 via piston rod 21, transmission link 19 and rod 18 throughout the bending process or during the process as required. Insufficient bending of the inner pipe 1A may occur when the force applied is less than 1/5, while furrows tend to appear on the inner side of the bend of the outer pipe 1B when the force applied is greater than 1. Pushing the inner pipe 1A toward its front end by piston 17 causes the force applied by piston 17 to be converted into a bending force that acts on the inner pipe 1A because the inner pipe 1A is coupled to the outer pipe 1B at its front end thereby resulting in a uniformity of the gap between the inner pipe 1A and the outer pipe 1B, see FIG. 6.

Figure 8:
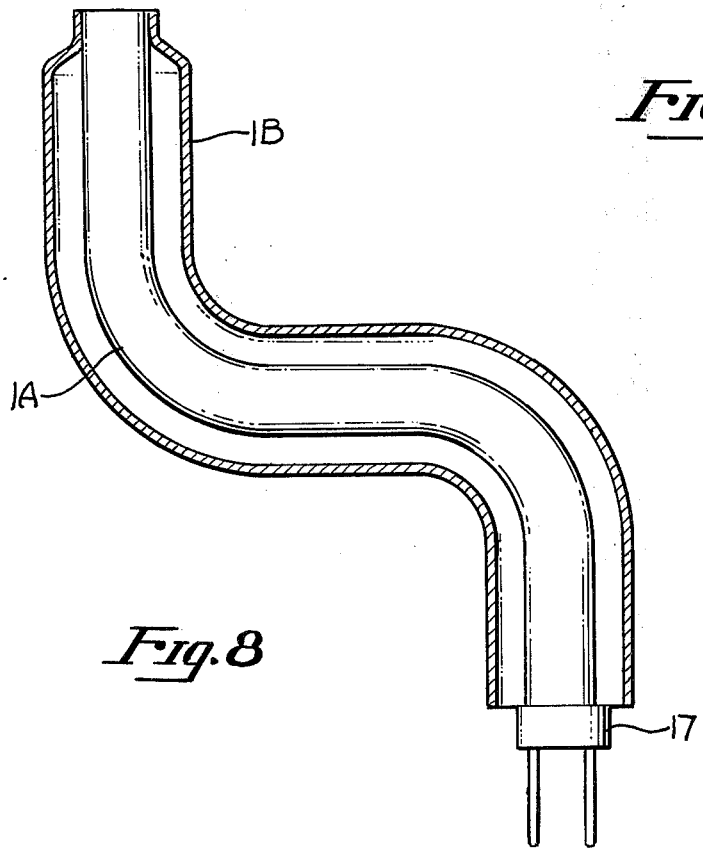
FIG. 8 is an enlarged cross-sectional view of the pertinent parts for the case where the double pipe is bent twice.

By a similar operation the double pipe 1 can be bent twice. As is shown in FIG. 8, it is only necessary to push the inner pipe 1A in the direction of the axis of that portion of the double pipe 1 being processed by piston 17. If the first bend in a double pipe bending process can be performed perfectly without applying compression by piston 17, it still is necessary to apply the compression force by piston 17 during the second bending process. Since the ends of the two pipes 1A and 1B are coupled together and there is no allowance for tension on the front end portion during the second bending operation, the portion already bent in the first process will be pulled toward the section being bent in the second process despite a perfectly computed first bend.

When the bending process is completed, metal core 13 is pulled out of the double pipe structure, then double pipe 1 is released from clamp mold 3 and press mold 5 and removed. Finally, bending mold 2 and clamp mold 3 are returned to their original positions by rotating the turntable 6 in an opposite direction to the direction of rotation W shown.

In all cases it is understood that the above-described embodiment is merely illustrative of but one of the many possible specific embodiments which can represent applications of the principles of the present invention. Numerous and varied other arrangements can be readily devised in accordance with these principles by those skilled in the art without departing from the scope of this invention.

I claim:

1. An apparatus for bending a double pipe comprising:

a turntable;

a bending mold fixed to said turntable;

a means coupled to said bending mold for fixing one end of a double pipe to prevent movement in a radial direction;

an inner metal core located laterally to said bending mold and adapted to be inserted into one end of a inner pipe of a double pipe;

a cylindrical outer metal core coaxial with said inner core inserted into one end of an outer pipe of a double pipe between said inner and outer pipes; and a means for exerting a force on an inner pipe in an axial direction while a double pipe is being bent whereby contact between said inner and outer pipes is avoided.

2. A apparatus for bending a double pipe according to claim 1 wherein said outer and inner metal cores are inserted into a double pipe such that one end thereof is adjacent the point of contact between the double pipe and said bending mold and lies in a plane passing through the axis of rotation of said turntable.

3. An apparatus for bending a double pipe according to claim 3 wherein said outer metal core has a concentric circular form having its center at the axis of rotation of said turntable.

4. A method for bending a double pipe comprising:

coupling the inner and outer of the double pipe together at one end;

inserting the end of the double pipe into a bending mold fixed to a turntable;

fixing the end of said double pipe opposite the coupled together end to prevent movement in a radial direction;

inserting an inner metal core and a cylindrical outer metal core into respectively said inner pipe and said outer pipe between said inner and outer pipes, said cores being inserted until the end is adjacent a contact point between said double pipe and said bending mold;

rotating the turntable thereby bending the double pipe along the contour of the bending mold; and applying a force to rear of said inner pipe in an axial direction while said turntable is being rotated.

5. A method for bending a double pipe according to claim 4 wherein the magnitude of the force applied to the rear of said inner pipe is between 20 and 100 percent of the force acting in the axial direction of the pipe due to the force applied to bend the double pipe.

* * * * *